US005915310A

United States Patent [19]

Hura et al.

[11] Patent Number: 5,915,310

[45] Date of Patent: Jun. 29, 1999

[54] APPARATUS AND METHOD FOR $NO_X$ REDUCTION BY SELECTIVE INJECTION OF NATURAL GAS JETS IN FLUE GAS

[75] Inventors: Harjit S. Hura, Wexford; Bernard P. Breen, Pittsburgh, both of Pa.; James E. Gabrielson, Plymouth, Minn.

[73] Assignee: Consolidated Natural Gas Service Company, Pittsburgh, Pa.

[21] Appl. No.: 08/507,928

[22] Filed: Jul. 27, 1995

[51] Int. Cl.[6] ..... F23J 15/00

[52] U.S. Cl. ..... 110/345; 110/203; 110/212; 110/213; 110/214

[58] Field of Search ..... 110/345, 203, 110/212, 213, 214

[56] References Cited

U.S. PATENT DOCUMENTS

| | | | |
|---|---|---|---|
| 2,671,314 | 3/1954 | Lichty | 60/39.02 |
| 4,038,032 | 7/1977 | Brewer et al. | 23/230 A |
| 4,425,159 | 1/1984 | Nixon | 75/29 |
| 4,528,918 | 7/1985 | Sato et al. | 110/347 |
| 4,597,342 | 7/1986 | Green et al. | 110/347 |
| 4,726,192 | 2/1988 | Willis et al. | 60/737 |
| 4,779,545 | 10/1988 | Breen et al. | 110/212 |
| 4,790,743 | 12/1988 | Leikert et al. | 431/8 |
| 4,810,186 | 3/1989 | Rennert et al. | 431/175 |
| 5,078,064 | 1/1992 | Breen et al. | 110/212 |
| 5,141,726 | 8/1992 | Breen et al. | 423/235 |
| 5,181,475 | 1/1993 | Breen et al. | 110/345 |
| 5,441,714 | 8/1995 | Oakes et al. | 423/235 |
| 5,520,123 | 5/1996 | Chappell et al. | 110/188 |

FOREIGN PATENT DOCUMENTS

| | | | |
|---|---|---|---|
| 0 280 568A2 | 8/1988 | European Pat. Off. | F23D 17/00 |
| 58-33015 | 2/1983 | Japan . | |
| 1809243 A1 | 4/1993 | U.S.S.R. . | |
| 2 005 822 | 4/1979 | United Kingdom . | |

OTHER PUBLICATIONS

"Enhancing the Use of Coals by Gas Reburning—Sorbent Injection," submitted at the Energy and Energy and Environmental Research Corporation (EERC), First Industry Panel Meeting, Pittsburgh, PA, Mar. 15, 1988.

"GR–SI Process design Studies for Hennepin Unit #1—Project Review," Energy and Environmental Research Corporation (EERC), submitted at the Project Review Meeting on Jun. 15–16, 1988.

"Reduction of Sulfur Trioxide and Nitrogen Oxides by Secondary Fuel Injection, " Wendt, et al.; *Fourteenth Symposium (International) on Combustion,* The Combustion Institute, 1973, pp. 897–904.

"Mitsubishi 'MACT' In–Furnace NOx Removal Process for Steam Generator", Sakai et al.; published at the U.S.–Japan NOx Information Exchange, Tokyo, Japan, May 25–30, 1981.

"Application of Reburning for NOx Control to a Firetube Package Boiler", Mulholland et al., Journal of Engineering for Gas Turbines and Power, Jul. 1985, vol. 107, pp. 739–743.

(List continued on next page.)

*Primary Examiner*—Ira S. Lazarus
*Assistant Examiner*—Ljiljana V. Ciric
*Attorney, Agent, or Firm*—Buchanan Ingersoll, P.C.

[57] ABSTRACT

A method of reducing $NO_x$ determines an $NO_x$ concentration profile within a zone of the furnace which is at a temperature below 2600° F. A stream of fluid fuel is injected into at least one region of relatively high $NO_x$ concentration so that the fluid fuel mixes therein with the flue gas. The fluid fuel is natural gas, hydrogen, $C_xH_y$ compounds, $C_xH_yO_z$ compounds or mixtures primarily of those compounds, in sufficient quantity to promote a reaction between nitrogen oxide in the flue gas and the fluid fuel, so as to substantially reduce nitrogen oxide content of the flue gas. The injector through which the fluid fuel is injected can be moveable and may have valves or deflectors to aid in directing the fluid fuel to regions of relatively high $NO_x$ concentration.

28 Claims, 4 Drawing Sheets

OTHER PUBLICATIONS

"Gas Reburning and Gas Injection in Combination with SNCR in a Waste Incineration Plant", Karll, International Gas Reburn Technology Workshop, Feb. 7–9, 1995, Malmö.

"Optimization of Natural Gas Reburning for Controlling Pollutant Emissions from Oil Fired Boilers", E. C. Moller et al., 1988 Spring Meeting, Western State Section/The Combustion Institute, Salt Lake City, Utah, Mar. 21–22, 1988.

APPARATUS AND METHOD FOR $NO_X$ REDUCTION BY SELECTIVE INJECTION OF NATURAL GAS JETS IN FLUE GAS

BACKGROUND OF INVENTION

1. Field of the Invention

The present invention relates to an apparatus and reburn method for in-furnace reduction of nitrogen oxide emissions in flue gas.

2. Description of the Prior Art

During combustion of fuels with fixed nitrogen such as coal, oxygen from the air may combine with the nitrogen to produce nitrogen oxides ($NO_x$). At sufficiently high temperatures, oxygen reacts directly with atmospheric nitrogen to form $NO_x$. Emission of nitrogen oxide is regarded as undesirable because the presence of nitrogen oxide in furnace flue gas (along with sulfur dioxides) causes the condensed gases to become corrosive and acidic. There are numerous government regulations which limit the amount of nitrogen oxide which may be emitted from a combustion furnace. Titles I and IV of the Clean Air Act as amended in 1990 ("the Clean Air Act") require significant $NO_x$ reduction from large power plants. Title I of the Clean Air Act focuses on the problem of ozone non-attainment. Ozone is formed as a result of photochemical reactions between nitrogen oxides emitted from central power generating stations, vehicles and other stationary sources, and volatile organic compounds. Ozone is harmful to human health. Consequently, in many urban areas the Title I $NO_x$ controls are more stringent than the Title IV limits. Thus, there is a need for apparatus and processes which reduce the nitrogen oxide emissions in furnace flue gas.

Commercially available techniques to reduce the nitrogen oxide emissions in furnace flue gas are low $NO_x$ burners, selective non-catalytic $NO_x$ reduction (SNCR), selective catalytic reduction (SCR) and reburning. Currently, retrofitting boilers with low $NO_x$ burners is the most economic route to comply with Title IV requirements of the Clean Air Act. However, low $NO_x$ burners cannot reduce $NO_x$ emissions to levels required by Title I of the Clean Air Act. As a consequence electric utilities are faced with the option of adding SNCR or reburning to the boiler. In addition, there are cyclone boilers for which there is no low $NO_x$ burner technology. SNCR and reburning are the two options for cyclone boilers.

The reburning process is also known as in-furnace nitrogen oxide reduction or fuel staging. The standard reburning process has been described in several patents and publications. See for example, "Enhancing the Use of Coals by Gas Reburning-Sorbent Injection," submitted by the Energy and Environmental Research Corporation (EER) at the First Industry Panel Meeting, Pittsburgh, Pa., Mar. 15, 1988; "GR-SI Process Design Studies for Hennepin Unit #1—Project Review," Energy and Environmental Research Corporation (EER), submitted at the Project Review Meeting on Jun. 15–16, 1988; "Reduction of Sulfur Trioxide and Nitrogen Oxides by Secondary Fuel Injection," Wendt, et al.; *Fourteenth Symposium (International) on Combustion,* The Combustion Institute, 1973, pp. 897–904. "Mitsubishi 'MACT' In-Furnace $NO_x$ Removal Process for Steam Generator," Sakai, et al.; published at the U.S.-Japan $NO_x$ Information Exchange, Tokyo, Japan, May 25–30, 1981.

In reburning a fraction of the total thermal input is injected above the primary flame zone in the form of a hydrocarbon fuel such as coal, oil, or gas. A reburn zone stoichiometry of 0.90 (10% excess fuel) is considered optimum for $NO_x$ control. Thus, the amount of reburn fuel can be calculated from the primary zone excess air. Under typical boiler conditions a reburn fuel input in the range 15% to 25% is sufficient to form a fuel-rich zone. The reburn fuel is injected at high temperatures in order to promote reactions under the overall fuel rich stoichiometry. Typical flue gas temperatures at the injection location are above 2600° F. Completion air is added above the reburn zone in order to burn off the unburnt hydrocarbons and carbon monoxide (CO). In addition to the above specifications the prior art on standard reburn teaches the benefits of rapid and complete dispersion of the reburn fuel in flue gas. Thus, flue gas recirculation (FGR) has been used to promote mixing in all standard reburn demonstrations. Standard reburn technology requires a tall furnace to set up a fuel rich zone followed by a lean burn out zone. Many furnaces do not have the volumes required for retrofitting this technology.

U.S. Pat. No. 4,810,186 titled, Apparatus For Burning Fuels While Reducing the Nitrogen Level, describes a standard reburn process for reducing $NO_x$ in tangentially fired furnaces. The taught process has a fuel rich zone followed by a burn out zone, and is limited to tangentially fired boilers. The patent describes tangentially-fired equipment having a plurality of main burners oriented in conformity with a burning circle, a plurality of reduction burners, and a plurality of burn-out or completion air nozzles disposed above the reduction burners. Thus, there are disposed in any burner plane, i.e. in a vertical plane, one above the other a main burner, a reduction burner, and a burn-out nozzle. In such a combustion configuration the fuel, air and burnt gas from each burner moves upwards in a helical trajectory, and "when the reduction burner is placed above the main burners there is no assurance that the reburning fuel will contact the $NO_x$ that is formed below." The authors show a helical path from only a single burner to emphasize their point. In actuality there are anywhere from 12 to 28 or more burners in a tangentially fired furnace and when the helical paths of flue gas from all the burners are considered it is clear that the reducing fuel from the reducing burners will contact the $NO_x$ from below. The patent states that the reburn fuel injectors be located in such a manner so as to maximize the contact between the $NO_x$ and the reburn fuel. However, it teaches that the reducing fuel injectors be placed along side the primary fuel injectors which is a very ineffective method for $NO_x$ control in coal fired furnaces.

The method of the '186 patent suffers from a single major drawback. It teaches reburn fuel injection at extremely high temperatures in the firing zone which is not ideal for $NO_x$ reduction using natural gas. Gas injection and combustion in the primary firing zone has little impact on $NO_x$ and may actually increase $NO_x$ formation. Gas injection in the primary firing zone of pulverized coal fired furnaces is known as co-firing. There are data from several gas/coal co-firing projects showing little if any reduction in $NO_x$ when natural gas is fired in this manner. The little $NO_x$ reduction can be explained by the decrease in the overall oxygen and by the decrease in the coal and coal bound nitrogen flow rate. The primary reason for the small $NO_x$ reduction is that gas co-injection delays coal combustion and conversion of coal nitrogen into nitrogen because gas burns much faster than coal.

Full scale demonstrations of standard natural gas reburning with FGR and completion air have shown up to 65% $NO_x$ reduction under the high temperature fuel rich conditions in several cyclone, wall, and tangentially fired boilers. Standard natural gas reburn as practiced today is expensive because of the capital and operating expense for FGR and completion air. In addition the need to create a fuel rich zone and the use of greater than 10% gas makes standard gas reburn uneconomical for most coal fired furnaces. Coal has also been used as a reburn fuel because it is much less expensive than natural gas. A finer coal grind than the typical utility grind used in the primary burners is required in order to improve coal devolatilization and promote char burnout in the upper furnace. However, coal has inherent bound nitrogen which can get oxidized to $NO_x$ during the completion process. For this reason, the use of coal as a reburn fuel is limited to initial $NO_x$ concentrations greater than 300 ppm. This effectively precludes the use of coal reburn in many furnaces equipped with low $NO_x$ burners.

Another chemical reagent based $NO_x$ reduction technique is the selective non-catalytic reduction (SNCR) process. In this process NO is reduced to nitrogen ($N_2$) by injecting any one of the following compounds: ammonia ($NH_3$), urea, or cyanuric acid into the furnace. All these compounds either directly (as in the case of ammonia de$NO_x$ process) or indirectly form amine radicals (NH, $NH_2$) which react subsequently with $NO_x$ in the flue gas to produce $N_2$. The process is called selective because the chemical reagents react selectively with $NO_x$. Thus, small amounts of the ammonia, urea, or cyanuric acid are required. For ammonia injection a concentration only 25% greater than the flue gas $NO_x$ concentration may be required for significant $NO_x$ reduction. Presence of small quantities of oxygen normally present in the flue gas are beneficial for starting the decomposition of the chemical additives. The relevant nitrogen chemistry in the SNCR processes is present in reburn as well, albeit to a lesser extent because the amine radical concentrations are lower. The SNCR chemistry is peculiar that it occurs in a narrow temperature window, from 1700° F. to 1900° F. At higher temperatures, the reagents may be oxidized to $NO_x$ under typical flue gas oxygen concentrations. At lower temperatures the reactions do not occur to a significant extent and reagent leakage or slip ($NH_3$, urea, cyanuric acid) can occur. The narrow process temperature window is a major drawback of the SNCR process, and results in lower than theoretical $NO_x$ reductions because of the difficulty in maintaining uniform spatial optimum injection conditions in boilers which operate at varying loads because of electric demand and dispatch requirements. Incomplete reagent mixing and dispersion also lowers the efficiency. Reagent leakage can cause ammonium sulfate particulate formation and deposits on downstream equipment. Emission of nitrous oxide ($N_2O$), a greenhouse gas and an intermediate product, from some SNCR processes is also of concern.

Consequently, there is a need for a combustion apparatus and process which will reduce nitrogen oxide emissions in flue gas and which can be readily used in existing furnaces. An improved reburn technology has been patented by Breen et al. in a series of patents (U.S. Pat. Nos. 4,779,545; 5,078,064 and 5,181,475) The new technology, called reducing eddy after burn (REAB), differs from the standard reburn in the following respects. Breen et al. inject raw natural gas or a stream of mostly natural gas as fuel eddies (as generated by a turbulent fuel jet, vortex rings or diffusive devices) whereas standard reburn uses turbulent gas jets with flue gas recirculation. REAB does not require and preferably does not use flue gas recirculation. $NO_x$ reduction occurs in locally fuel rich zones, such as fuel eddies and vortex rings, in contrast to a globally fuel rich zone. Slow or controlled mixing of natural gas with flue gas is required, in contrast to rapid mixing in standard reburn. Natural gas is injected at lower temperatures, from 1800° F. to 2400° F., consistent with chemical kinetics. Operating at lower temperatures enables potentially higher $NO_x$ reductions because the thermodynamic equilibrium $NO_x$ is less than 125 ppm at 1800° F. In the REAB process there is no need for completion air addition since the furnace is over all fuel lean. Mix out and oxidation of the unburnt hydrocarbons and CO from the local fuel rich zones occurs due to the existing turbulence in the flow. REAB is less expensive than standard reburn because it uses less natural gas, does not require flue gas recirculation, and does not require completion air.

Recently we filed a U.S. patent application Ser. No. 08/417,916 describing an improvement of the REAB technology, called the controlled mixing upper furnace $NO_x$ reduction technology (CM/UFNR). In CM/UFNR a combustible fluid such as natural gas is introduced into the upper furnace through gas fired gas jet injectors. In these injectors a small portion of the natural gas is combusted with air (or vitiated air); the resultant gas is mixed with the majority of the natural gas; and the mixture is then injected into the furnace as a very fuel-rich jet. The combustion of a small fraction of natural gas is used to modulate the momentum of the gas jet and consequently its mixing characteristics. The combustion increases the temperature and velocity of the resultant jet, results in early hydrocarbon radical formation and thus accelerates the rate of the reburn chemistry. The injection of these jets into the furnace results in a complex mixing process which can be described by the formation and shedding of fuel rich eddies from the main jet. In these eddies the nitrogen oxide formed in the coal burner will be reduced to ammonia, cyanide-like fragments, and $N_2$. As these eddies decay and mix with the flue gas, they experience an oxidizing environment, where the ammonia like compounds react with more $NO_x$ to form nitrogen. As mentioned above, these selective "thermal de$NO_x$" reactions occur in a narrow temperature range of 1700° F. to 1900° F. Therefore, the gas fired gas jets are designed and located in such a manner so as to take advantage of the thermal de$NO_x$ chemistry. Thus, the nitrogen oxide in the flue gas is reduced at the same time that the combustion of natural gas is completed. In standard reburn a significant portion of the hydrogen cyanide (HCN) and amine ($NH_i$) species formed in the fuel rich zone is oxidized to NO because the completion air is added at gas temperatures greater than 2200° F.

The REAB and CM/UFNR technologies are well suited for retrofitting existing coal furnaces. Because the process relies on controlled mixing to provide fuel-rich and fuel-lean environments, there is no need for an air addition stage. Because gas burns more rapidly at a lower temperature than coal, the fuel can be introduced at a higher elevation and lower temperature in the furnace. This lower temperature acts to reduce the equilibrium level of nitrogen oxide in the flue gas and, hence, increases the potential nitrogen oxide reduction. The cost of reducing $NO_x$ is decreased because duct work is not necessary for injection of completion air or recirculated flue gas, and less natural gas is used. Therefore, both capital and operating costs are lower than in standard reburn. While the REAB and CM/UFNR processes give a 40–60% reduction in $NO_x$ using 7–10% natural gas, it is clear that there is a need for the spatial injection process described below.

SUMMARY OF THE INVENTION

In accordance with the present invention there is provided an improved apparatus and process for reducing the nitrogen oxides in furnace flue gas. We have found that $NO_x$ is not uniformly distributed within a furnace. For any selected cross section through a furnace above the primary combustion zone there will be regions of relatively high $NO_x$ concentration and regions of relatively low $NO_x$ concentration. The $NO_x$ non-uniformity is a consequence of the spatial non-uniformity of primary zone fuel and air injection. These areas can be identified through the use of sampling probes or by computational furnace modeling of the furnace. Our process relies on achieving high $NO_x$ reductions by injecting natural gas and other fluid fuel into the flue gas in regions of high NO in a temperature window from 1500° F. to 2600° F. Under typical flue gas conditions NO reductions of 40% to 90% are possible at a natural gas input of 5% to 15%. Hence, the present process is capable of achieving the 60% to 90% $NO_x$ reductions which are required in some Title I affected areas of the United States. No overfire air injection is needed since the furnace is always maintained fuel lean. The natural gas could be injected with air or vitiated air, or with a steam carrier.

We prefer to provide a set of gas injectors positioned around the furnace wall at the selected furnace elevation. Preferably each injector is comprised of a pipe through which pure natural gas or mostly natural gas is injected or the injector is comprised of an outer pipe through which a mixture of a combustible gas and air is injected and an inner pipe through which pure natural gas is injected. A steam line can be connected to the injector for injecting steam to assist the gas injection. The volume of gas injected and the velocity of the injected gas can be controlled by valves in the injectors or in the supply lines for the injectors. The locations within the furnace into which the gas is injected can be determined by feedback of the optimum $NO_x$ reduction effect through artificial intelligence continually searching and controlling the volume and velocity of the gas injection as well as by selective use of steam assist/or firing of the injectors.

Other objects and advantages of the invention will become apparent as a description of the preferred embodiments proceeds.

DESCRIPTION OF THE PREFERRED EMBODIMENT

Figure 1:
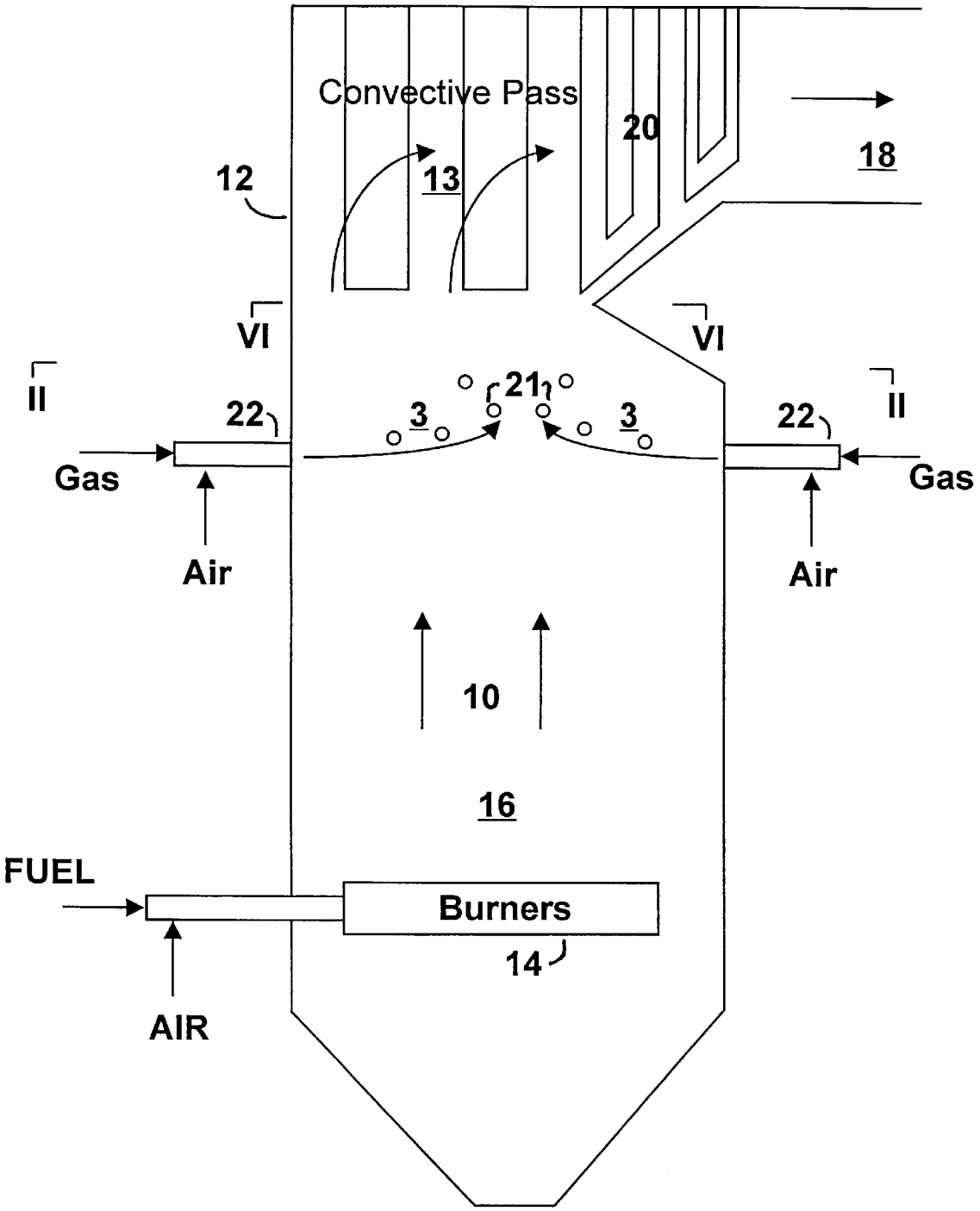
FIG. 1 is a schematic of a furnace having our apparatus for reducing nitrogen oxide emissions.
Figure 2:
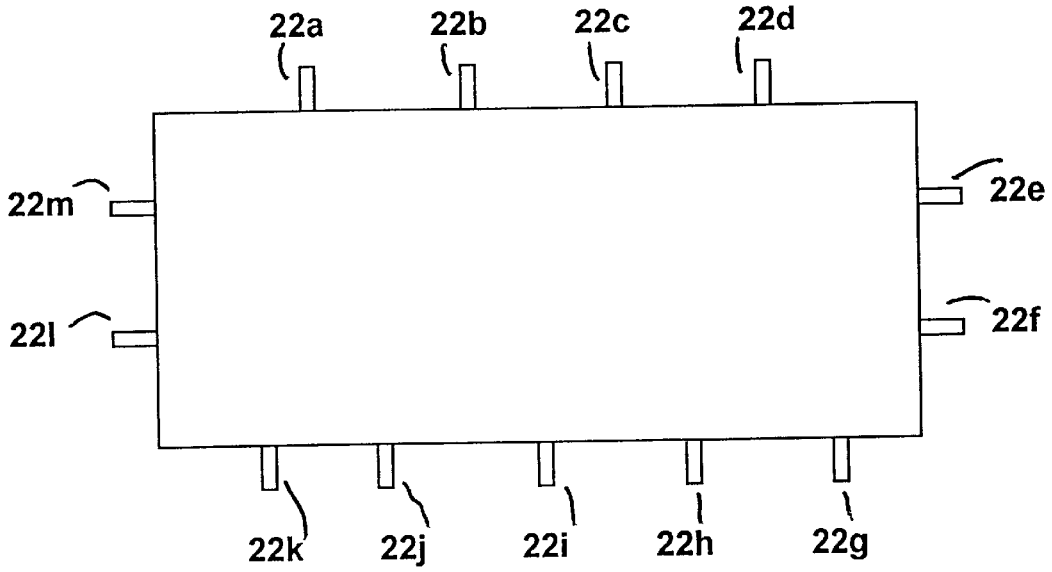
FIG. 2 is a cross-sectional view of the furnace shown in FIG. 1 taken along the line II—II in FIG. 1.

A bottom fired furnace 12 is shown in FIGS. 1 and 2. The furnace has a set of burners 14 near the bottom. The burners are designed to utilize coal or any other fuel. The fuel burns in the primary combustion zone 16 of the device within which temperatures are typically in excess of 3000° F. Combustion products 10 flow upward from the combustion zone 16 through connective pass 13, past heat exchangers 20, through duct work 18 and out of the furnace. The flue gas has a temperature of 1800° F. to 2400° F. when it exits the furnace near the heat exchanger 20. Heat exchangers 20 in the upper portion of the furnace cause the temperature to drop very rapidly and any unburned fuel which enters these heat exchangers usually will be wasted and will exit the furnace as hydrocarbon emissions.

Figure 3:
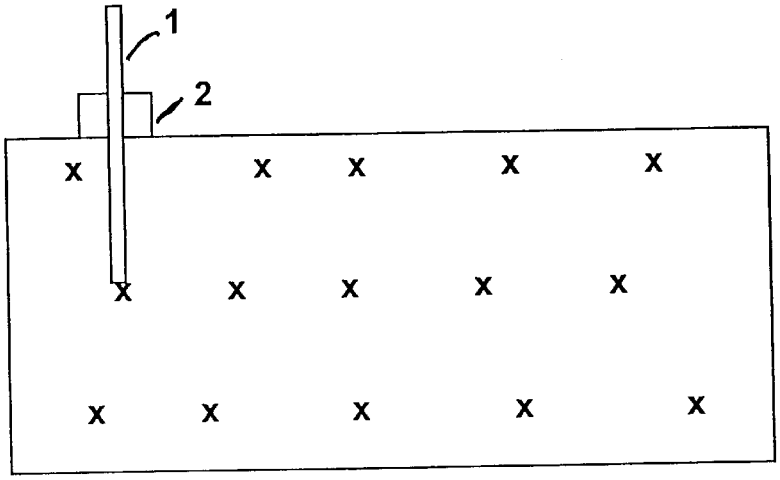
FIG. 3 is a cross-sectional view similar to FIG. 2 illustrating the use of a probe to determine an $NO_x$ concentration profile of the zone of the furnace through which the cross-section was taken.

During the combustion of the fuel, some of the fuel bound nitrogen will react with oxygen to form $NO_x$ and some $NO_x$ will be formed from atmospheric nitrogen and oxygen. In bottom fired furnaces as well as in tangentially fired units and roof fired units, and even in other furnace designs there are regions of high $NO_x$ formation and high $NO_x$ concentration. One method of finding the areas of relatively high $NO_x$ is to insert a sampling probe 1 through ports 2 in the furnace wall as illustrated in FIG. 3. The tip of the probe is positioned at selected locations indicated by the letter "x" throughout a cross-section through the furnace. Samples are drawn from each location and analyzed to determine $NO_x$ concentration at that location. The readings are used to create an $NO_x$ concentration profile of the sampled zone of the furnace. The $NO_x$ concentration profile is essentially a contour map of the cross-section with each contour corresponding to an $NO_x$ concentration level. Within the profile there will be regions of relatively high $NO_x$ concentration, typically as much as 1000 ppm. and regions of relatively low $NO_x$ concentration, often less than 250 ppm. Another method of obtaining a $NO_x$ concentration profile is by computer modeling of the fluid flow, chemical reactions, and heat and mass transfer processes in the furnace.

Our process reduces $NO_x$ by injecting natural gas jets in the high $NO_x$ regions inside the combustion device 12 between the combustion zone 16 and the heat exchanger 20. We provide gas injectors 22 in FIG. 1 and 22*a* thru 22*m* in FIG. 2 to reduce the nitrogen oxide emissions in the combustion products. Air or steam could also be co-injected in order to modulate the penetration and mixing of the natural gas jets. When air is added, the air flow is controlled to burn a small amount of gas in the injector. The injector then introduces high temperature, high momentum, fuel-rich, turbulent jets into the furnace as described in our patent application Ser. No. 08/417,916. The flue gas temperature at the location of jet introduction is in the range 1800° F. to 2600° F. The jets mix and entrain the $NO_x$ containing flue gas to create fuel-rich eddies 21 where the $NO_x$ is reduced to $N_2$, $NH_3$,and HCN.

Figure 4:
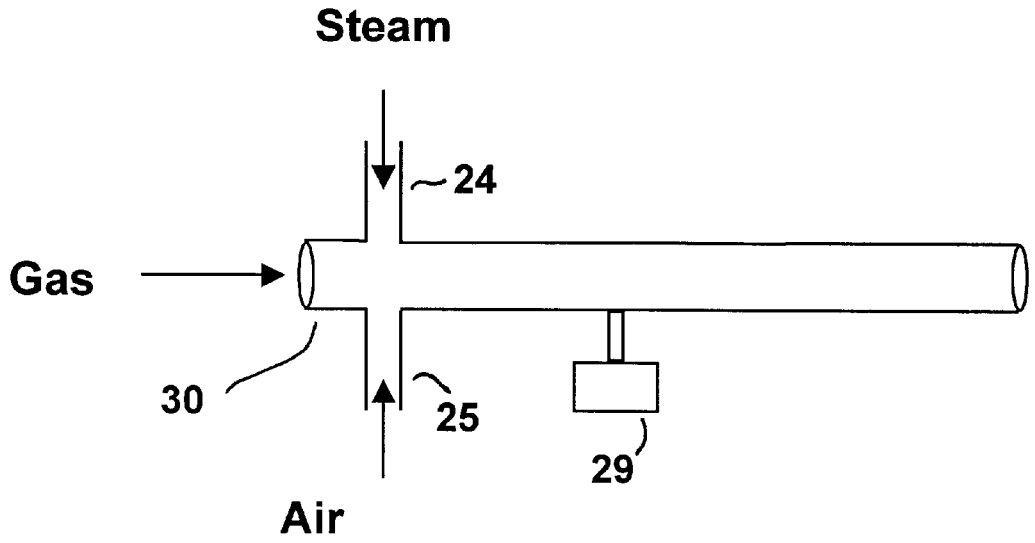
FIG. 4 is a diagram of the present preferred injector.
Figure 5:
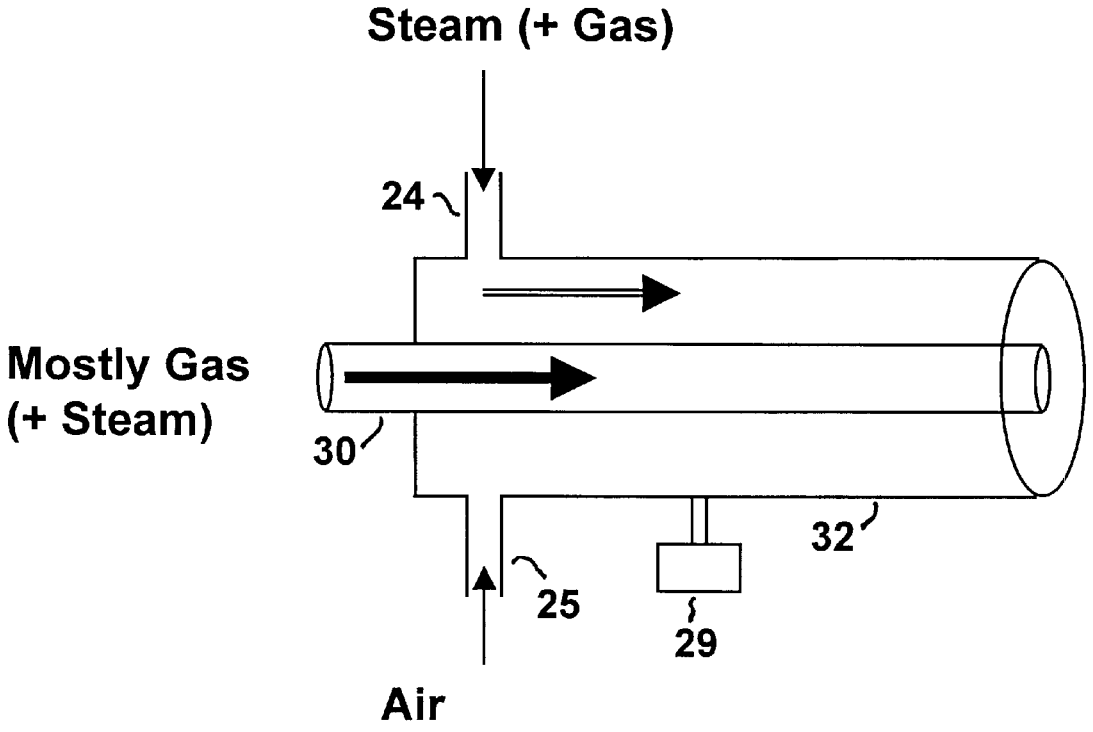
FIG. 5 is the diagram of the second preferred injector.

FIG. 4 shows a schematic of the preferred injector. The injector consists of single pipe 30 (circular or rectangular) through which natural gas is supplied. Air, vitiated air, and/or steam could be co-injected through the pipes 24 and 25 in order to modulate the jet mixing. FIG. 5 shows a second preferred injector design. It consists of two pipes 30 and 32 with mostly gas (and some steam, if needed) supplied through the inner pipe 30, and mostly air, vitiated air, steam, and some gas supplied through the outer pipe 32. In both the preferred injector designs a servo motor 29 can be provided to cause the injector to tilt and yaw and thereby direct the stream to a desired location on the furnace. This enables us to direct the injected fuel into areas of high $NO_x$ concentration. Where there are a series of injectors around the periphery of the furnace as shown in FIG. 2, the input of reburn fuel can also be directed by selectively firing the injectors 22*a* thru 22*m*.

Although this disclosure discusses primarily $NO_x$ control in furnaces, the approach of exploiting the existing heterogeneity of a pollutant (more generally a reactant) concentration distribution in a reactor to decrease the amount of second reagent injection is not limited thereto. It is applicable to any situation where non-uniformities in the flow can be exploited to reduce process costs. For example the SNCR process discussed above could also benefit from the techniques described in this invention. The SNCR process would benefit from reagent (urea, ammonia, etc) injection into the high $NO_x$ zones in the flue gas.

The present invention is an improvement over the Controlled Mixing Upper Furnace $NO_x$ Reduction technology described in our U.S. patent application Ser. No. 08/417,916. It is based on our observation that non-uniform distributions of $NO_x$ and $O_2$ exist in several practical furnace designs. As a result of these observations we concluded that the reburn fuel (coal, oil or gas) should be selectively injected in the high $NO_x$ regions of a furnace, and not well mixed with the flue gas as is done in standard reburn. Indeed, reburn fuel injection into low $NO_x$ containing zones is ineffective. Similarly indiscriminate injection of reburn fuel accompanied by rapid mixing as practiced in standard reburn is also wasteful of the reburn fuel. Therefore, we provide a sophisticated approach to $NO_x$ control in furnaces. The approach is contrary to the well mixed uniform reactant technology practiced in all chemical reactors because it increases, although temporarily, the non-uniformity in the reactor. Typical chemical reactors are designed for rapid and complete mixing because rapid mixing between reagents improves product yield and decreases the potential for reactant leakage. Our method and apparatus also involves rapid and complete mixing between reactants but in local regions of a reactor. In the case of $NO_x$ control the local regions are defined as the regions of highest $NO_x$. It is a riskier approach because it requires a deeper knowledge and understanding of the flow non-uniformity, turbulent mixing, and process chemistry.

The non-homogeneity in $NO_x$ profiles across the furnace is inherent in many furnace designs such as tangentially fired, cyclone fired, wall fired, roof fired and opposed fired units. The extent of non-uniformity varies from one design to another. In tangentially fired units the fuel and air is fired into the furnace from the four corners. Typically the fuel is fired into the furnace center while the air is offset from the center. The combustion of the primary fuel occurs at the interface of the fuel and air jets in an annular region. Therefore, $NO_x$ is formed in this annular region and high $NO_x$ concentrations exist there. The non-uniformity in $NO_x$ is extreme in the firing zone but decreases due to turbulent diffusion and mixing as the flue gas moves away from the firing zone. In cyclone fired boilers the $NO_x$ formed inside the cyclones is injected into the lower furnace as high velocity jets. The $NO_x$ is well mixed with the flue gas as it comes out of the cyclone. However, as a result of the high velocity swirling jets impinging on the furnace back wall most of the flue gas and $NO_x$ is flowing up along the back wall. Thus, gas injection must be concentrated along the back wall.

Figure 6:
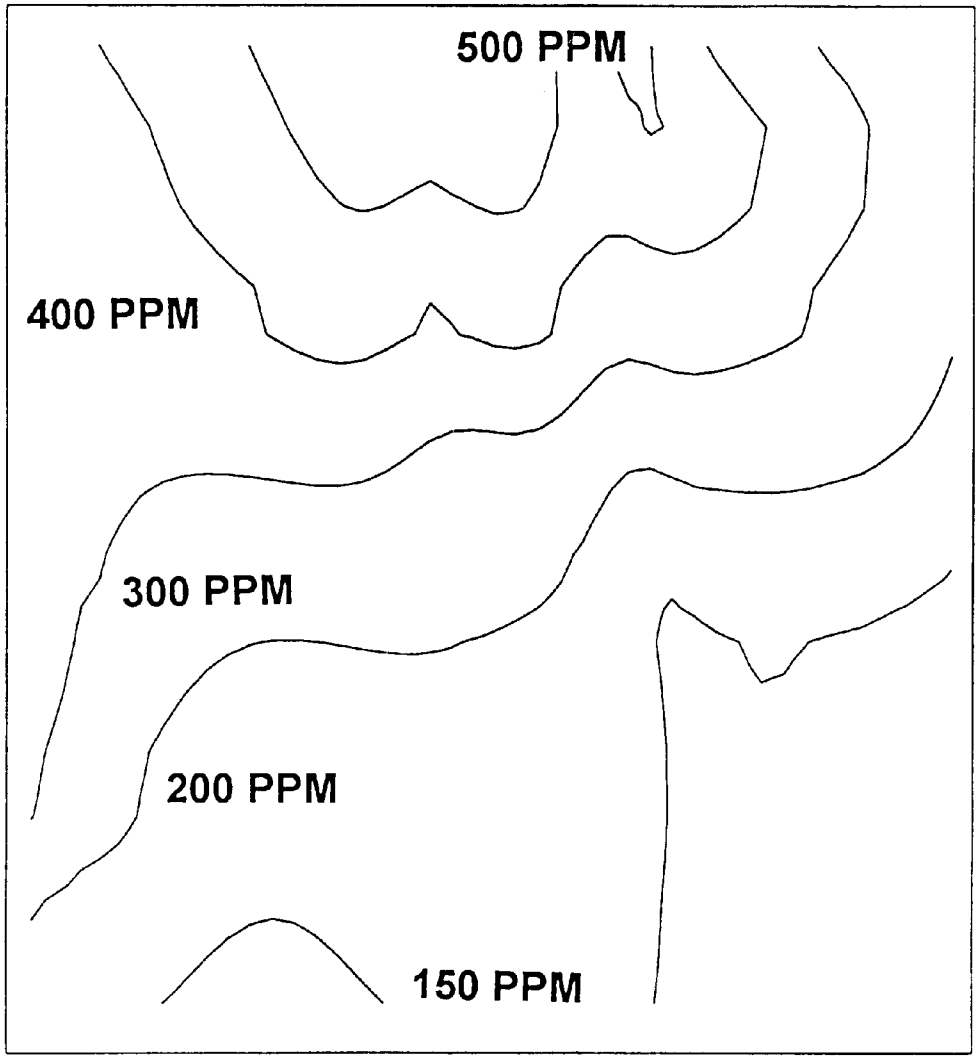
FIG. 6 is an $NO_x$ concentration profile diagram showing non-uniform $NO_x$ concentration levels in a furnace equipped with a low $NO_x$ burner and overfire air apparatus taken across a horizontal cross section of the furnace indicated by line VI—VI in FIG. 1.

Such non-homogeneity in $NO_x$ is present in some roof fired units and cyclone fired boilers as well. FIG. 6 shows the $NO_x$ concentration in a roof fired unit which was retrofitted with a low $NO_x$ burner/overfire air system. Each region is labeled in parts per millon $NO_x$. The profile was generated from a validated computational furnace model of Duquense Light Company's Elrama Unit 3 furnace. As can be observed the $NO_x$ is concentrated along one wall of the furnace. Thus, natural gas must be injected where the $NO_x$ is. Rapid mixing of natural gas, even when assisted with flue gas recirculation, or injection from both walls of the furnace is inefficient. The latter is particularly inefficient because there is little $NO_x$ on one side of the furnace. The gas injected there just burns and may produce $NO_x$. For optimum $NO_x$ reduction the locally fuel rich gas/flue gas mixture must persist four times longer than the chemical kinetic time. This enables the destruction of $NO_x$ to $N_2$, $NH_3$, and HCN to occur completely. Table I shows the chemical kinetic times for the reburn process for well mixed isothermal conditions. The chemical kinetic time is a strong function of temperature and varies from 25 ms at 2600° F. to 600 ms at 2000° F. Due to heat release during combustion of natural gas the fuel eddy temperature could be 200 to 400° F. higher than the background flue gas temperature. Thus, the $NO_x$ reduction is predicted to occur rapidly even at flue gas temperatures of 1800° F.

TABLE I

Chemical Kinetic Reburn Times

| Reburn Temperature, ° F. | Stoichiometry | Chemical Time, ms |
|---|---|---|
| 2000 | 1.0 | 600 |
| 2400 | 1.05 | 50 |
| 2400 | 1.0 | 100 |
| 2600 | 1.0 | 25 |

Table II shows the maximum $NO_x$ reduction as a function of initial $NO_x$ under optimum conditions of temperature and stoichiometry. As can be seen the $NO_x$ reductions decrease rapidly as the initial $NO_x$ level falls below 200 ppm. These calculations were performed using a comprehensive chemical kinetic model of more than 200 elementary reactions for methane combustion and nitrogen chemistry. The mechanism had over 200 elementary reactions among over 40 species.

TABLE II

PREDICTED $NO_x$ REDUCTIONS AT STOICHIOMETRY [AIR TO FUEL] = 0.90 and T = 2600° F.

| Initial $NO_x$, ppm | $NO_x$ reduction, % |
|---|---|
| 1000 | 90 |
| 800 | 88 |
| 200 | 72 |
| 50 | 34 |

Consider now a furnace cross-section with a mean $NO_x$ concentration of 500 ppm. However, lets assume that ½ of the furnace mass flow is at 1000 ppm while the remaining ½ has no $NO_x$ in it. Then, by adding gas only to the region where the $NO_x$ is a 90% reduction in total $NO_x$ can be achieved. The gas required to achieve this reduction will be less than that required if the total furnace had to be made fuel rich. Now lets consider the case where there the $NO_x$ is uniformly distributed in the furnace. In this case the $NO_x$ reduction will be about 80% but significantly more natural gas will be needed. The gas jet system is also designed to ensure than the fuel eddies burn out completely before leaving the furnace. Thus the local fuel-rich zones created by the jets must mix out completely with the remaining flue gas in order to limit the carbon monoxide and unburned hydrocarbon emissions from the furnace. This mix out process is designed to occur in the temperature range 1800° F. to 2000° F. where the $NH_3$ present in the fuel-rich eddies further reacts with NO and reduces NO to $N_2$ due to the thermal de$NO_x$ reactions.

This process reduces nitrogen oxide emissions by several methods. First, natural gas or other preferred hydrocarbon has no fixed nitrogen so no nitrogen oxides are produced from the source. Thus, the nitrogen oxide emission per Btu of fuel fired is decreased due to displacement of coal by natural gas. Secondly, the gas is injected at temperatures below 3000° F. and therefore, thermal nitrogen oxide formation is negligible. Thirdly, the natural gas reduces the NO in the flue gas because of reactions with $CH_i$ and $NH_i$ radicals. The partial oxidation and pyrolysis of the hydrocarbon fuel results in the formation of $CH_i$ radicals which react with NO to form HCN. This initial chemistry is followed by radical abstraction reactions of HCN which results in $N_2$, $NH_3$ and $NH_i$ radical formation, and further NO reduction by the amine radicals. This sequence of reactions is favored under fuel rich conditions; under well mixed fuel lean conditions competing oxidation reactions reduce reburn effectiveness. Fourthly, the amine radicals selectively reduce NO during the burn out process at 1700° F. to 1900° F. Fifthly, the direct addition of natural gas to the high NO zones results in lower gas usage for similar NO reductions. Thus significant savings in process cost for ton of $NO_x$ removed can be achieved by decreasing gas use. In standard reburn technology up to 18% natural gas is used in contrast to the present technology in which less than 10% gas will be needed for similar $NO_x$ reductions. The $NO_x$ reductions could be improved even further by adding ammonia or urea to the natural gas.

While we have shown and described certain preferred embodiments of the invention it is to be distinctly understood that the invention is not limited thereto, but may be otherwise variously embodied within the scope of the following claims.

We claim:

1. An improved apparatus for reducing nitrogen oxide in flue gas in a furnace wherein a fuel is burned in a primary combustion zone and produces a flue gas containing nitrogen oxide that passes through a zone in which the flue gas has a known concentration profile wherein there are at least two regions, at least one region of higher $NO_x$ concentration and at least one region of lower $NO_x$ concentration wherein the improvement comprises at least one injector attached to the furnace and positioned for injecting a secondary combustible fuel along an axis which intersects a wall of the furnace at an angle and into the at least one region of higher $NO_x$ concentration and also comprises a motor connected to the at least one injector for changing the angle at which said axis intersects the furnace wall.

2. The apparatus of claim 1 wherein the at least one injector is positioned to introduce the fuel into a region of said furnace where the flue gas is at a temperature of 1600° F. to 2600° F.

3. The apparatus of claim 1 wherein the at least one injector is a plurality of fluid fuel injectors designed and operated to provide a mixing time longer than a $NO_x$ reduction chemical kinetic time.

4. The apparatus of claim 1 wherein the at least one injector is a plurality of fluid fuel injectors designed and operated to effect mixout of fuel-rich eddies in a temperature zone of 1600° F. to 2200° F.

5. The apparatus of claim 1 wherein the at least one injector is capable of supplying 0% to 25% of the total thermal input into the furnace.

6. The apparatus of claim 1 wherein the at least one injector is capable of supplying 0% to 100% of stoichiometric air required to combust all injected fuel.

7. The apparatus of claim 1 where the at least one injector is comprised of a single tube carrying at least pure natural gas for mixing modulation.

8. The apparatus of claim 1 where the at least one injector is comprised of an inner tube carrying pure natural gas, and an outer tube transporting a mixture of a combustible gas and at least one of air, vitiated air, steam, and flue gas.

9. The apparatus of claim 1 also comprising an air input line connected to the at least one injector.

10. The apparatus of claim 1 wherein the at least one injector is a plurality of fluid fuel injectors sized and positioned to inject natural gas in greater amounts into at least one region of higher NO concentration and to inject natural gas in lesser amounts into the at least one region of relatively low $NO_x$ concentrations.

11. The apparatus of claim 1 also comprising a steam line connected to the at least one injector for assisting the injection of natural gas.

12. An improved furnace of a type which burns hydrocarbon fuel to produce $NO_x$-containing flue gas wherein a fuel is burned in a primary combustion zone and produces a flue gas containing nitrogen oxide that passes through a zone in which the flue gas has a known concentration profile, wherein there are at least two regions, at least one region of higher $NO_x$ concentration and at least one region of lower $NO_x$ concentration and wherein the improvement comprises at least one injector positioned and attached to the furnace for injecting a secondary combustible fuel along an axis which intersects a wall of the furnace at an angle and into the at least one region of higher $NO_x$ concentration and a motor connected to the at least one injector for changing the angle at which the axis intersects the furnace wall.

13. The improved furnace of claim 12 wherein the at least one injector is positioned to introduce the fuel into a region of the furnace where the flue gas is at a temperature of 1600° F. to 2600° F.

14. The improved furnace of claim 12 wherein the at least one injector is capable of supplying 0% to 25% of the total thermal input into the furnace.

15. The improved furnace of claim 12 wherein the at least one injector is capable of supplying 0% to 100% of stoichiometric air required to combust all injected fuel.

16. The improved furnace of claim 12 where the at least one injector is comprised of a single tube carrying at least pure natural gas for mixing modulation.

17. The improved furnace of claim 12 where the at least one injector is comprised of an inner tube carrying pure natural gas, and an outer tube transporting a mixture of a combustible gas and at least one of air, vitiated air, steam, and flue gas.

18. The improved furnace of claim 12 also comprising an air input line connected to the injector.

19. The improved furnace of claim 12 wherein the at least one injector is a plurality of fluid fuel injectors sized and positioned to inject natural gas in greater amounts into the at least one region of higher $NO_x$ concentration and to inject natural gas in lesser amounts into the at least one region of lower $NO_x$ concentration.

20. The improved furnace of in claim 12 also comprising a steam line connected to the at least one injector for assisting the injection of natural gas.

21. An in-furnace method of reducing nitrogen oxides in flue gas comprising the step of:

a. selecting a zone in the furnace through which the flue gas passes at a temperature not greater than 2600° F.;

b. determining an $NO_x$ concentration profile within the zone wherein said profile reveals at least one region of higher $NO_x$ concentration and at least one region of lower $NO_x$ concentration;

c. injecting a stream of fluid fuel into the at least one region of higher $NO_x$ concentration so that the fluid fuel mixes therein with the flue gas, said fluid fuel being selected from the group of fluids consisting of natural gas, hydrogen, $C_xH_y$ compounds, $C_xH_yO_z$ compounds and mixtures primarily of said $C_xH_y$ compounds and said $C_xH_yO_z$ compounds, in sufficient quantity to promote a reaction between said nitrogen oxide in the flue gas and said fluid fuel, so as to substantially reduce the nitrogen oxide content of the flue gas.

22. The method of claim 21 wherein the fluid fuel is introduced into an upper part of the furnace.

23. The method of claim 21 wherein the furnace has a convective zone, and wherein the said fluid fuel is introduced into the convective zone.

24. The method of claim 21 wherein the flue gas temperature is within the range 1600° F. to 2600° F.

25. The method of claim 21 wherein at least one of air and vitiated air is injected with the fluid fuel.

26. The method of claim 21 where no additional air is injected above a location at which the fluid fuel is injected.

27. The method in claim 21 wherein the fluid fuel is injected in greater amounts into the at least one region of higher $NO_x$ concentration and is injected in lesser amounts into the at least one region of lower $NO_x$ concentration.

28. The method in claim 21 wherein the fluid fuel is injected at a higher velocity into the at least one region of higher $NO_x$ concentration and is injected at a lower velocity into the at least one region of lower $NO_x$ concentration.

* * * * *

UNITED STATES PATENT AND TRADEMARK OFFICE

CERTIFICATE OF CORRECTION

PATENT NO. : 5,915,310

DATED : June 29, 1999

INVENTOR(S) : HARJIT S. HURA, BERNARD P. BREEN, JAMES E. GABRIELSON

It is certified that error appears in the above-indentified patent and that said Letters Patent is hereby corrected as shown below:

Column 10, line 10, change "NO" to --$NO_x$--.

Column 10, line 12, change "relatively low" to --lower--.

Signed and Sealed this

Sixteenth Day of May, 2000

*Attest:*

Q. TODD DICKINSON

*Attesting Officer*

*Director of Patents and Trademarks*